US007386903B2

(12) United States Patent
Hochschild

(10) Patent No.: US 7,386,903 B2
(45) Date of Patent: Jun. 17, 2008

(54) COMPOSITE MATTRESS ASSEMBLY AND METHOD FOR ADJUSTING THE SAME

(75) Inventor: Arthur A. Hochschild, Garden Grove, CA (US)

(73) Assignee: American Pacific Plastic Fabricators, Inc., Garden Grove, CA (US)

( * ) Notice: Subject to any disclaimer, the term of this patent is extended or adjusted under 35 U.S.C. 154(b) by 52 days.

(21) Appl. No.: 11/504,752

(22) Filed: Aug. 14, 2006

(65) Prior Publication Data

US 2007/0022540 A1 Feb. 1, 2007

Related U.S. Application Data

(63) Continuation-in-part of application No. 11/145,374, filed on Jun. 3, 2005, now Pat. No. 7,191,483.

(51) Int. Cl.
*A47C 27/15* (2006.01)

(52) U.S. Cl. ..... 5/740; 5/691; 5/727; 5/722

(58) Field of Classification Search ..... 5/720, 5/730, 722, 727, 738, 740, 691, 903
See application file for complete search history.

(56) References Cited

U.S. PATENT DOCUMENTS 3,604,025 A * 9/1971 Mims ..... 5/730
3,939,508 A * 2/1976 Hall et al. ..... 5/727
5,513,402 A * 5/1996 Schwartz ..... 5/691
5,960,496 A * 10/1999 Boyd ..... 5/722
6,052,851 A * 4/2000 Kohnle ..... 5/690
6,159,574 A * 12/2000 Landvik et al. ..... 428/71
6,954,957 B2 * 10/2005 Metzger et al. ..... 5/706

* cited by examiner

*Primary Examiner*—Michael Trettel
(74) *Attorney, Agent, or Firm*—Squire Sanders & Dempsey LLP

(57) ABSTRACT

A composite mattress assembly has multiple layers, where one or more of the layers are foam layers and the rest are spring coil mattress layer(s). The composite mattress assembly may be made exclusively of foam layers as well. Any of the layers can be divided into two halves, which is divided longitudinally to support two people. Each half may independently have a layer which is made from a different material or different density or thickness in the case of a foam layer from that of the other half, according to two differing user preferences. A top casing is provided to encase the top layer, and a core casing is provided to enclose the bottom layers, where the two casings are zipped together along mating peripheral circumferential edge. Additionally, methods to adjust the firmness, temperature and the like of all of the foregoing composite mattress assembly are provided.

19 Claims, 4 Drawing Sheets

COMPOSITE MATTRESS ASSEMBLY AND METHOD FOR ADJUSTING THE SAME

RELATED APPLICATION

This application is a CIP application of, and claims priority from, an earlier application, application Ser. No. 11/145,374 filed Jun. 3, 2005, now U.S. Pat. No. 7,191,483, entitled Composite Foam Mattress Assembly of the same sole inventor, Arthur A. Hochschild. The entire content of the earlier parent application is hereby incorporated by reference.

BACKGROUND OF THE INVENTION

Standard mattress designs have evolved very little in the past fifty years. A standard mattress generally includes a set of metal springs or coils mounted either on a base under a pad, or sandwiched in the center of a pair of pads. The metal springs and pad or pads are then covered with a strapping material. The entire structure is then sewn into a cloth cover and the edges are wrapped and sewn. Thus, once the mattress is fabricated, the components are not replaceable. The limitations of metal spring mattresses combined with improved quality and durability of foam products has lead to the relatively recent development of a foam core mattress as a viable alternative to metal spring mattress. A foam core mattress can provide significant improvements in comfort and support compared to conventional spring-based mattresses. For example, spring-based mattresses inherently have varying properties over their surface, and the variations of properties relating to zone and surface areas are improved only with great difficulty.

A basic foam mattress may include one or more layers of foam having desirable properties assembled into a fabric cover so as to appear identical in appearance to a standard metal spring mattress. A foam mattress may include a center core of relatively high resilience foam sandwiched between two layers of lower resilience foam encased in a fabric shell. This construction allows for a reversible mattress.

The reaction of a user to a mattress is highly personal, and the prospective purchaser in the showroom is likely to decide to purchase or not to purchase a product within a few minutes. The most prevalent explanation for the return of the mattress relates to an aspect of the comfort of the user or users specifically the perceived temperature and firmness of the mattress. It is commonly observed that most people spend 6 to 8 hours each day in bed. Accordingly, in marketing mattresses to consumers, the retail stores typically stress the quality and the comfort of the mattress, to justify sales price of a high quality mattress. Many retailers who offer high end mattress products also offer a guarantee allowing the purchaser to return the mattress if they are not completely satisfied within a certain time period. As a result, it is not uncommon for retail stores to have return rates of eight to ten percent. These levels of return are significant and indeed compounded by the stigma attached to a "used" mattress that may only be resold at best at about ten percent of its original sales price.

INVENTION SUMMARY

It is an object of this invention to provide a method of building and marketing composite foam mattress assemblies and a resulting bed in which the properties of the mattress may be modified in the sectors, sections or elongated halves, of the mattress and in the zones of the mattress. For example, a different firmness or response for the left sector and the right sector may be desirable. Also, different firmnesses to support the zones for the head, the torso, and the legs may be desirable to custom fit a mattress for one or two users.

It is another object of this invention to provide composite foam and spring mattress assemblies where a mattress is made from a combination of foam layers or sectors and spring mattress layers or sectors. The foam and spring mattress layers or sectors are interchangeable according to a user preference.

This invention offers to the merchant and to the user a wide range of demonstrable and selectable responses. As a result customers can customize their mattress, providing the retailer with a much greater opportunity to make the sale of an expensive product that depreciates instantly upon sales. Furthermore, in the event of dissatisfaction, the local properties of the mattress can later be modified by replacement of localized parts rather than having the purchaser return a mattress.

Accordingly, the present invention provides an improvement over the standard foam mattress, providing an alterable and reconfigurable composite mattress as described herein having a plurality of vertical zones, each formed beneath a respective horizontal sector, there being a plurality of horizontal sectors whereby the load-responsive properties of the sectors can be selected and provided in such a way as to be locally responsive and supportive. The construction is enclosed in a multi-piece fabric encasement having a removable cover allowing user access to the foam and spring mattress components.

The above and other features of this design will be fully understood from the following detailed description and the accompanying drawings, in which:

DETAILED DESCRIPTION OF THE PREFERRED EMBODIMENTS

Figure 1:
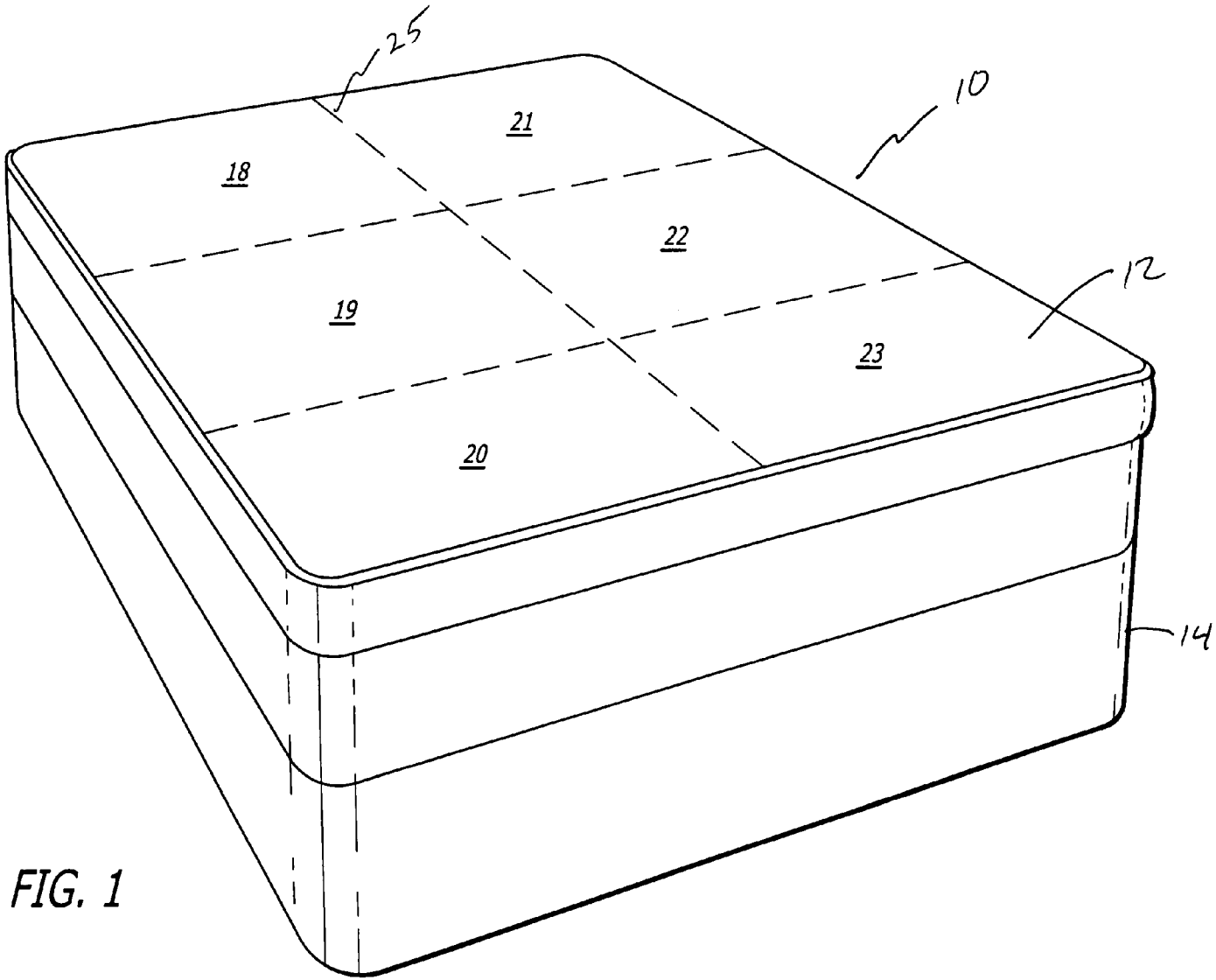
FIG. 1 is a perspective view of a mattress assembly.
Figure 2:
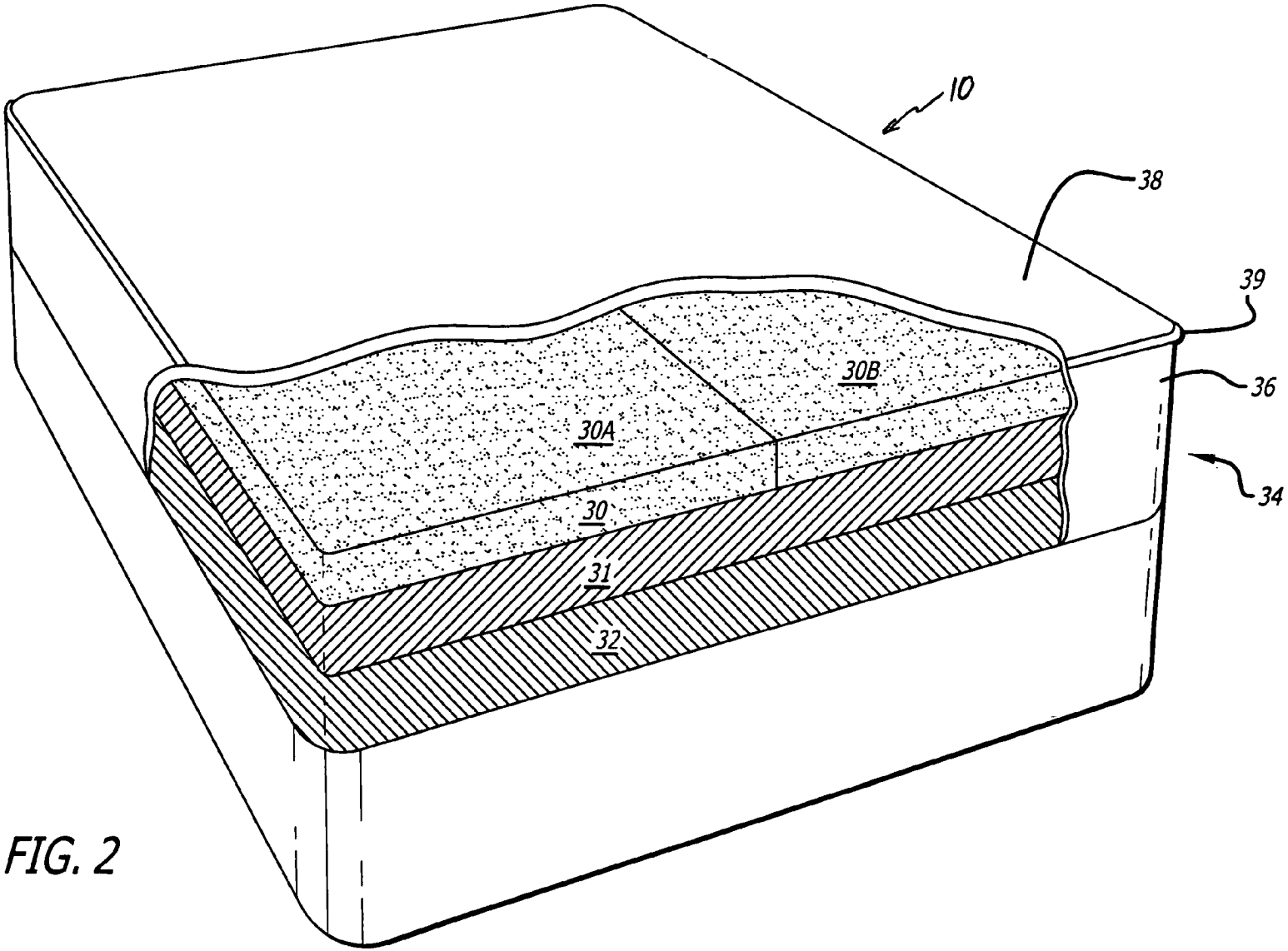
FIG. 2 is a perspective, partially cut-away view of the mattress assembly.
Figure 3:
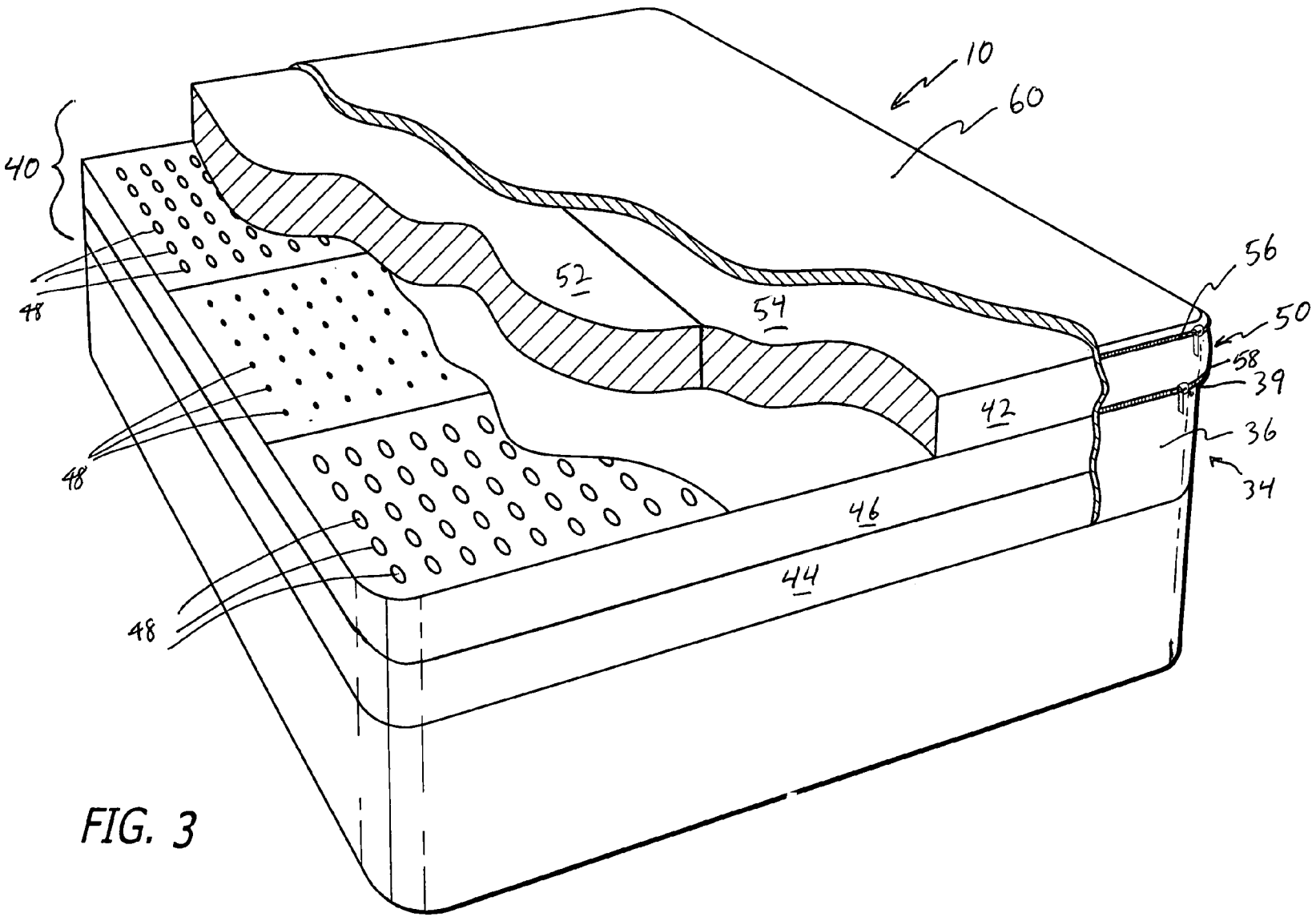
FIG. 3 is a perspective, partially cut-away view of an alternative configuration of a mattress assembly.

Mattress assemblies 10 according to aspects of the present design are shown in FIGS. 1-3. FIG. 1 shows a perspective looking down toward the upper surface 12 of a mattress assembly 10. It is shown as a mattress assembly 10 suitable for use by two persons. The mattress assembly 10 is shown on top of a box foundation 14.

For reference herein, the mattress assembly 10 has a first longitudinal phantom line 25 dividing the mattress into a left sector and a right sector. Further, horizontal phantom lines show the division of the mattress sectors into zones 18, 19, 20 and 21, 22, 23. Zones 18 and 21 will be located beneath the head and shoulders of a user; zones 19 and 22 beneath the torso; and zones 20 and 23 beneath the legs and feet. These regions of the mattress assembly 10 are intended to be configurable and thereby responsive to each of those respective parts of the body of the user(s).

FIG. 2 shows a perspective, partially cut-away view of the mattress assembly 10 having an internal construction that may be made up of a top layer 30, middle layer 31, and bottom layer 32. These layers may each be provided with physical properties selectable to provide appropriate and desired support to the portion of the body which rests atop each zone. In some of these layers, the adjacent regions or zones may be identical, and in others the properties may vary.

The mattress of FIG. 2 may be configured from blocks of foam material. Ultimately they may merely be stacked, or after approval of function, they may be cemented or taped together. Also, some blocks in a given layer may be provided as a continuous body having uniform properties or a continuous body with different local properties from sector to sector and zone to zone.

Most frequently, a king or queen size mattress will have a top layer 30 divided longitudinally in two parts 30A and 30B as shown in FIG. 2 so as to allow respective left and right sides of the mattress assembly to be selectively interchangeable with foam blocks having specific characteristics selected to be more comfortable to persons resting on a respective side. Alternatively, the layers may be formed as a continuous body that may include local modifications, for example channels formed in the foam block that may be spaced in a manner to impact the resilience of the foam block.

The foam blocks making up the top layer 30, middle layer 31 and bottom layer 32 are assembled into a mattress casing or core casing 34 made of fabric and having an underside (not shown) and sidewall 36 six to twelve inches high defining a cavity for the foam blocks.

A removable and interchangeable mattress cover 38 extends over the top layer 30 and is secured at its peripheral edge to the upper edge of the sidewall 36 by a zipper 39. Preferably, the zipper 39 has equal number of teeth on the mattress cover 38 and on the sidewall 36.

FIG. 3 depicts an alternative embodiment of the mattress assembly 10. In FIG. 3, the mattress assembly 10 is also shown in a partially cut-away view. The mattress assembly 10 in this embodiment includes a three zone latex foam core 40. A first zone 42 and a third zone 44 preferably have a similar resilience while a second zone 46 in the center portion of the bed extending across a double, queen size or king size bed has a more dense urethane latex foam core. Each of the foam blocks may have a plurality of spaced apart openings 48 as shown in the blocks of the second zone 46 which provide air pockets increasing the cushioning effect of the foam core. The second and third zones 46 and 44 are enclosed within the mattress casing 34 including an underside (not shown) and sidewalls 36 six to twelve inches high. The fabric cover has a zipper 39 at the upper periphery of the sidewalls 36. Removal of the foam cores and reconfiguration of the mattress assembly 10 may be accommodated by opening the zipper and removing one or more of the foam cores for replacement with a foam core having a different configuration.

Placed on top of the mattress casing 34 of the mattress assembly 10 is an overlay cover 50. The overlay cover 50 includes a bottom sheet 56, sidewall 58 and top 60. The overlay cover 50 includes one or more foam elements 52 and 54 forming the first zone 42 and constrained within the cavity defined by the bottom sheet 56 and sidewall 58. Preferably the overlay cover is one to three inches in thickness.

The foam elements 52, 54 may be either latex foam block or blocks or plush memory or viscoelastic foam block or blocks depending on the preference of the user. The overlay cover 50 may be replaceable so that if a user selects a latex foam block and decides at a subsequent time that they would prefer the viscoelastic foam block then the overlay may be opened and the foam block can be replaced. The foam overlay includes a zipper 56 which allows for removal of the foam elements 52, 54 from the overlay cover 50. In addition, on the bottom periphery of the overlay cover is a zipper component which allows connection to the zipper located on the upper portion of the mattress casing 34. The zipper on the top of the overlay allows for a selection of alternate materials for the top 60 of the overlay cover. The top 60 of the overlay cover may be formed from a stretch cover material, a quilted stretch with cashmere cover material or a pillow top cover. The selection of the respective top 60 or cover to go over the foam elements 52, 54 allows for a greater flexibility in design and selection of mattress qualities to enhance the salability of the mattress assembly.

The interchangeability of the components of the mattress assembly, including the removable and replaceable top of the overlay cover, its replaceable top, the replaceable foam cores in the overlay cover, and the replaceable or switchable foam core elements contained in the mattress casing 34 provides for a unique ability to reconfigure the mattress to a user or even different users in locations such as within a hotel, without having to move and replace an entire mattress. In addition, for users that purchase a mattress and then decide that they would like a different feel to the mattress, the ability to have removable elements so that one element can be removed and replaced and thereby give the user a different feel for the mattress substantially increases the perceived value of the mattress to the consumer.

There is also a significant advantage to the retailer of the mattress as the retailer will reduce or minimize the number of returns of mattresses from customers who are dissatisfied because of the feel of the mattress. Instead, the retailer can determine with the user what portion of the mattress assembly is unsatisfactory and replace only that portion of the mattress assembly so as to provide a complete unit that has acceptable performance for the consumer. The result of this interchangeability is to substantially reduce the number of returns of mattresses after purchase by a consumer.

This is particularly beneficial in that a return mattress cannot be resold once it has been used. Thus, a dissatisfied customer who returns a standard type of a mattress which does not offer the replacement or repair capabilities is a substantial cost overhead to the mattress retailer. The ability to replace only a component of the system so as to provide the customer with the preferred mattress characteristics is therefore a substantial advantage both to the retail facility and to the marketing and distribution of the mattress assembly of the present invention.

As may be appreciated by those skilled in the art, having a removable mattress cover which may be replaced by alternative mattress covers which are matched so as to have the same zipper teeth count allows mattress covers to be removed and washed or removed and replaced. Thus, if the mattress cover is not providing the desired comfort level, then the mattress cover or top such as a pillow top cover can replace a stretch cover so as to allow additional padding and spacing as between the user and the foam core of the overlay. If the mattress is too springy, then the latex foam core and the overlay may be replaced with the viscoelastic plush memory foam blocks in the overlay cover to make the matters less springy and softer.

The overlay cover 50 shown in FIG. 3 can also be utilized in the mattress assembly 10 of FIG. 2 by removing the cover 38 on the assembly of FIG. 2 and replacing it with the foam overlay cover of FIG. 3. This configuration puts the foam overlay atop the three layer foam core construction of the configuration of FIG. 2.

For those in the industry, the ability to reconfigure the mattresses quickly and thereby custom tailor the mattress to a particular user, or to replace certain components for the user so as to prevent, minimize or eliminate returns by unsatisfied customers is a substantial advantage over the construction of mattresses which have the components completely encased within a fabric cover. A modular system allows the seller of the product to offer a better value to customers and to arrange the various mattresses in the showroom so as to promote each of the aspects of the mattress configuration and allow a user the best opportunity to select their prefer mattress configuration.

Accordingly, the materials for the various sectors and layers will depend on the choices made by the person or persons who will use the mattress. A very heavy person for example will generally prefer a mattress which does not yield as readily as one for a lighter-weight person. A pillow top cover 60 is warmer and softer than a stretch cover.

Also, the nature of the foam forming each block is of importance. Many persons prefer a springy mattress. For this a closed-cell foam is most desirable. Others prefer a slower yielding, less springy support, dependent on rate of application of weight and temperature. For these people, often an open cell foam is preferable on the top layer or zone. Another type of foam can be either open or closed celled, but whose material is inherently viscoelastic and rate sensitive.

The mattress as a unit should ordinarily tend to be more reluctant under the heavier parts of the body, namely the central sectors, and more readily responsive to the head and the legs. In most cases, the bottom layer will be stronger and less yielding, while the top layer will tend to be more accommodating. The central layer may have any suitable response, but ordinarily will provide a response intermediate between that of the top and bottom layers.

Suitable foams are well-known in the art and require no detailed description here. The objective is to provide a mattress with a top layer that is comfortable and compatible with the physical shape and condition of the user, yieldable for comfort but returning to shape when the weight is removed, supported by a less-resilient middle layer atop a suitable bottom layer that can support weight without excessive deflection.

The choice of properties of the various regions is open to experimentation with the objective of ultimately providing to the user a bed which will accommodate the user comfortably. The choice of properties for each zone and sector available from this invention will enable the manufacturer and seller of mattresses to make available to the ultimate user a wide range of comfort and accommodation.

Foams vary dramatically in physical properties as they relate to response to compressive loads. One of the determinating factors is the density of the foam. Foams with lighter density have more voids than foams of greater density. The low density foams will "feel" softer, and depending on cell size and whether the cells are open or closed, will be less or more springy.

In addition, the molecular configuration of the matrix material will in part determine the feel (firmness) of the mattress. A layer of foam with a higher degree of rigidity will be less yielding and likelier to restore itself quickly. A viscoelastic material responds not only to the applied load, but also to the rate at which the load is applied. A quickly applied load will find a reluctant response, while the same load applied slowly will experience a more gradual, but ultimately complete response.

Also, a closed cell foam will be springier, because the compressive of the foam is resisted by the need to compress the gas in the cells. In contrast an open cell foam permits flow of gas from cell to cell, through the various and many restricted passages between cells, and will thereby be a cushioned response.

Urethane and latex foams are most commonly used, with densities varying from about 1.8 pounds to 5.00 pounds per cubic foot of the usual foam material, whether open or closed cell. As described above, the firmness and response (liveliness) of the bed can be selected by choosing among forms in this range.

Figure 4:
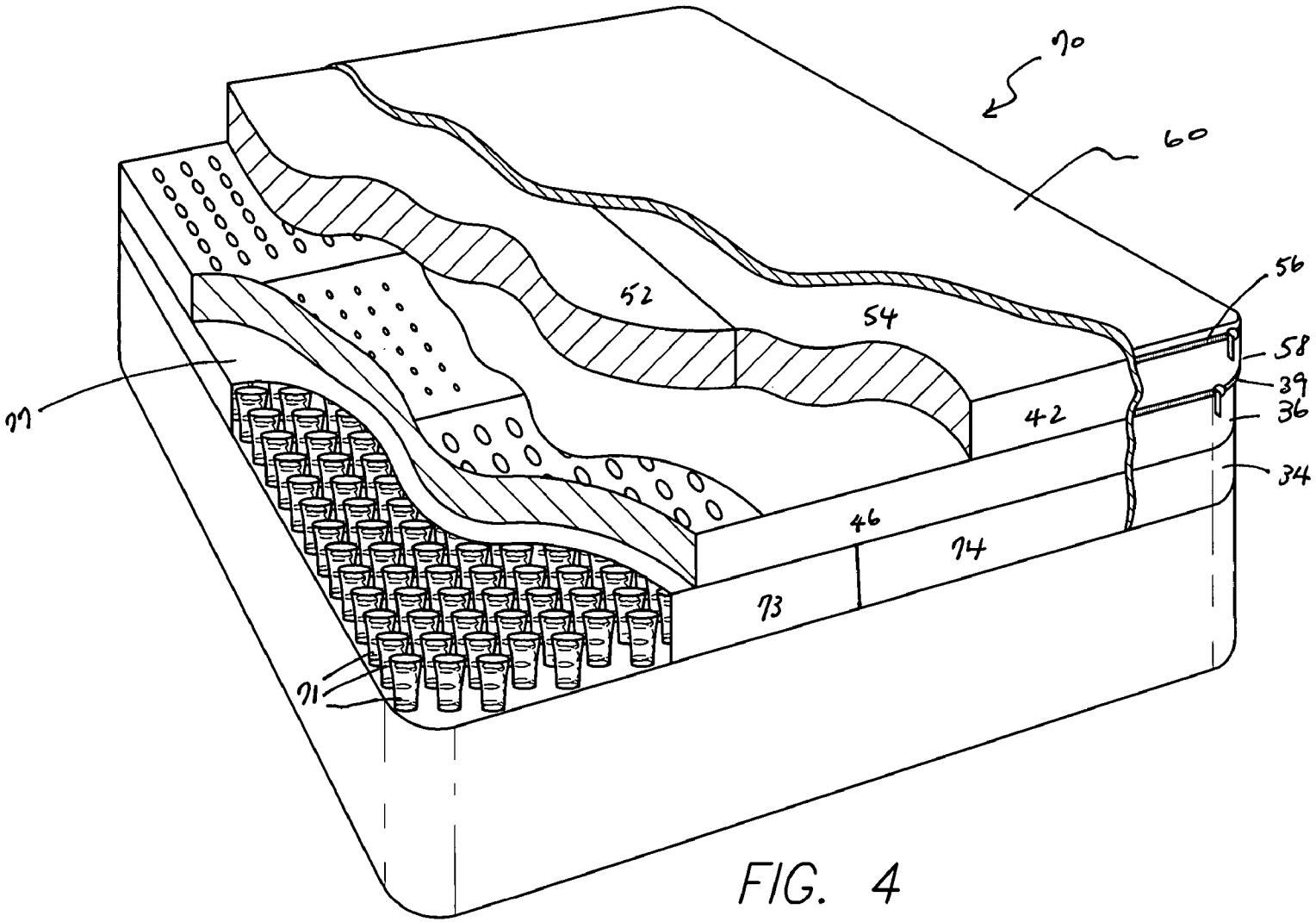
FIG. 4 is a perspective view of a composite foam and spring mattress assembly.

In FIG. 4, a composite foam and spring mattress assembly 70 according to the present invention is shown. Many of the components identified by the same numerical identifications are the same as those of FIG. 3. Further, the composite foam and spring mattress assembly of FIG. 4 employs an interchangeable combination of foam components and spring mattress components. Instead of a third zone 44 of the assembly of FIG. 3, the bottom layer of this assembly is split into two halves 73 and 74. The left half 73 is a spring mattress. The other section or elongated half 74 in that layer is made of foam.

This particular assembly is an example of a foam and spring mattress assembly. There are many different combinations of assemblies where both foam layers or sections and spring mattress layers or sections are used. The combination can freely be chosen and dictated by a user's preference.

To illustrate a further example, the foam elements 52 can be exchanged for a spring mattress half in a mattress assembly. The second zone 46 may be a combination of a foam half and a spring mattress half. Different zones such as zones 18, 19 and 20 can be a combination of foam and spring mattress zones as well. Zone 21 can be an extra-firm spring mattress and the zones 22 and 23 can be medium firm foam layers.

Yet another embodiment according to the present invention is a composite mattress assembly having a layer of spring mattress, a layer of foam and a layer of air mattress. The foam layer could be over laid over the spring mattress. This composition is more economical since it contains a layer of spring mattress. Air mattress is of any of a conventional type which can be adapted to use as a half of a layer or a whole of a layer in a composite mattress assembly. An individual zone may be made up of a foam material, spring, or air mattress. Hence, to illustrate an example, in FIG. 4, instead of the spring mattress layer 73 and the foam layer 74, the composite mattress assembly could employ a single layer of air mattress. Alternatively, the air mattress could be the middle layer in place of the second zone 46.

If desired, when the correct selection is assembled, it may be glued together to form a unitary mattress, or may be left "loose" for future change. The thickness of the layers may also be varied. Often the bottom layer will be thicker, while the upper layer may be only 1½ to 2 inches thick. The thickness of all of the layers can be varied to suit the customer's needs and preferences.

As may be appreciated from the foregoing description, in a broad sense the present invention is a method of marketing composite foam mattresses and responding to customer satisfaction concerning the feel of a composite foam mattress assembly. The mattress is configured by forming a mattress cover having an underside and sidewalls extending upward from the underside a height of six to twelve inches to define a cavity, the sidewalls having one side of a zipper assembly attached to their upper peripheral edge, forming foam sheets of differing materials having differing physical properties into blocks sized to fit within the mattress cover cavity so as to fill the cavity defined by the mattress cover utilizing one or more of the foam sheets, and forming a plurality of cover layers of differing materials all having a mating side of a zipper assembly to match with the zipper assembly of the mattress cover. The store or retail outlet may then configure several mattresses having differing arrangements of the foam sheets in the mattress cover cavity and cover layers of differing materials to demonstrate the different support and feel of the various mattress configurations to allow a consumer to select a mattress assembly configuration suited to the customers requirements at the time of purchase. The store can then effectively assemble the mattress for the customer. With this custom assembly, the store can economically extend a money back return policy in the event that any customer concerns about the comfort of a mattress assembly cannot be remedied. After the sale, the store may receive and respond to customer concerns concerning the comfort of the mattress assembly providing at least one replacement component for the mattress assembly to remedy the customer concern and decrease the incidence of mattress assembly returns. A payment on the money back return policy is effectively prevented or minimized as customer comfort issues can almost always be resolved.

In other words, the money back return policy may include a number of differing levels of refund. For instance, it could involve a complete and full money back. It could be a small percentage such as five, ten or fifteen percent refund. Such a percentage may be in the range of five to twenty percent of the price of the mattress assembly. Again, it could be a minimal, small refund to a full refund.

Instead of a money back return policy, a store credit may be issued in the event of a dissatisfaction on the part of the buyer or in a case of a buyer's remorse. An exchange guarantee may be issued in lieu of either a money back return policy or a store credit. In any case, regardless of what type of guarantee is issued, having the option to replace one or more component reduces the burden on the retailer carrying the composite foam mattress assemblies by increasing the likelihood that a customer is satisfied and preventing the return of the composite foam mattress assembly.

With the foregoing in mind, it should be understood that this invention is not to be limited by the embodiments shown in the drawings and described in the description, which are given by way of example and not of limitation, but only in accordance with the scope of the appended claims.

What is claimed is:

1. A composite foam mattress assembly comprising:

a bottom layer of mattress;

a middle layer of mattress disposed over the bottom layer of mattress;

a top layer of mattress disposed over the middle layer of mattress;

a top casing for enclosing the top layer of mattress;

a first zipper half having a predetermined number of zipper teeth along a lower outer peripheral edge of the top casing;

a core casing for enclosing the middle and bottom layers of mattress; and a second zipper half having a predetermined number of zipper teeth along an upper peripheral edge of the core casing, the second zipper half capable of coupling with the first zipper half;

wherein at least one half or one layer of mattress in the core casing contains a plurality of metal springs.

2. The composite foam mattress assembly of claim 1, wherein the middle layer of mattress has three zones, at least one zone having different physical properties from the other two zones.

3. The composite foam mattress assembly of claim 2, wherein each of the three zones has a plurality of openings at a predetermined distance from one another.

4. The composite foam mattress assembly of claim 1, wherein the middle layer of mattress has three zones, and two of which are situated away from each other and have substantially the same physical properties.

5. The composite foam mattress assembly of claim 4, wherein the physical properties include resilience.

6. The composite foam mattress assembly of claim 1, wherein at least one half of the top layer of mattress has three zones, each zone having different physical properties from the other two zones.

7. The composite foam mattress assembly of claim 1, wherein the top layer of mattress has two halves placed side by side, each half of the top layer of mattress has three zones, two zones of which are situated at distal ends of the composite foam mattress assembly and have substantially the same physical properties.

8. The composite foam mattress assembly of claim 7, wherein the two zones at the distal ends are made of urethane latex foam.

9. The composite foam mattress assembly of claim 7, wherein each of the three zones has a plurality of openings at a predetermined distance from one another.

10. The composite foam mattress assembly of claim 1, wherein the bottom layer of mattress and the middle layer of mattress are made of a material or materials from a group of soft urethane foam, hard urethane foam, and viscoelastic memory foam.

11. The composite foam mattress assembly of claim 1, wherein the top layer of mattress is made from a material or materials selected from a group of latex foam, soft urethane foam, hard urethane foam and viscoelastic memory foam.

12. The composite foam mattress assembly of claim 1, wherein the metal springs are individually wrapped spring coils.

13. A method of adjusting a composite mattress assembly, comprising:

providing a bottom layer of mattress;

providing a middle layer of mattress disposed over the bottom layer of mattress;

providing a top layer of mattress disposed over the middle layer of mattress;

providing a top casing for enclosing the top layer of mattress;

providing a first zipper half having a predetermined number of zipper teeth along a lower outer peripheral edge of the top casing; and providing a second zipper half having a predetermined number of zipper teeth along an upper peripheral edge of a core casing for enclosing the middle and bottom layers of mattress, the second zipper half capable of coupling with the first zipper half;

wherein at least one of the layer of mattress in the core casing contains a plurality of metal springs.

14. The method of claim 13, wherein the metal springs are individually wrapped spring coils.

15. The method of claim 13, wherein the middle layer of mattress has three zones, at least one zone having different physical properties from the other two zones.

16. The method of claim 13, wherein the middle layer of mattress has three zones, and two of which are situated away from each other and have substantially the same physical properties.

17. The method of claim 16, wherein the physical properties include resilience.

18. The method of claim 13, wherein at least one half of the top layer of mattress has three zones, each zone having different physical properties from the other two zones.

19. The method of claim 13, wherein the top layer of mattress has two halves placed side by side, each half of the top layer of mattress has three zones, two zones of which are situated at distal ends of the composite foam mattress assembly and have substantially the same physical properties.

* * * * *